United States Patent [19]

Sosnowski et al.

[11] 4,419,054

[45] Dec. 6, 1983

[54] LIQUID FUEL INJECTION PUMPING APPARATUS

[75] Inventors: Stanislaw J. A. Sosnowski, London; Robert T. J. Skinnger, High Wycombe, both of England

[73] Assignee: Lucas Industries Limited, Birmingham, England

[21] Appl. No.: 261,150

[22] Filed: May 7, 1981

[30] Foreign Application Priority Data

Jul. 2, 1980 [GB] United Kingdom ..... 8021634

[51] Int. Cl.[3] ..... F04B 19/02; F04B 29/00

[52] U.S. Cl. ..... 417/294; 417/461; 417/462; 417/221; 123/502

[58] Field of Search ..... 123/502, 503, 504; 417/461, 462, 463, 294

[56] References Cited

U.S. PATENT DOCUMENTS 4,074,667 2/1978 Skinner ..... 417/462

FOREIGN PATENT DOCUMENTS 2334600 1/1975 Fed. Rep. of Germany ..... 123/502

1394178 5/1975 United Kingdom ..... 123/502

2031187 4/1980 United Kingdom ..... 123/502

2054206 2/1981 United Kingdom ..... 123/502

2068591 8/1981 United Kingdom ..... 123/502

*Primary Examiner*—Carlton R. Croyle

*Assistant Examiner*—Jane E. Obee

[57] ABSTRACT

A liquid fuel injection pumping apparatus of the rotary distributor type includes a cam ring which is angularly adjustable to vary the timing of delivery of fuel. The setting of the cam ring is determined by a piston in which is located a servo valve. The servo-valve has a land to control fluid flow into a cylinder containing the piston. The servo valve is spring biased and a wedge is provided between a cylindrical member engaged by a spring and the servo-valve, the wedge being movable to alter the distance of the portion of the land which controls fluid flow of the servo valve. The wedge is coupled to the output member of a speed responsive device, the output member also being coupled to a fuel quantity control of the apparatus so that the setting of the cam ring depends upon the amount of fuel delivered by the apparatus.

9 Claims, 7 Drawing Figures

LIQUID FUEL INJECTION PUMPING APPARATUS

This invention relates to a liquid fuel injection pumping apparatus of the kind comprising a body, a rotary distributor member in the body, a drive shaft coupled to the distributor member and arranged in use to be driven in timed relationship with an associated engine, a bore in the distributor member, a plunger in the bore, an annular cam ring surrounding the distributor member and having cam lobes which impart inward movement to the plunger as the distributor member rotates, fluid pressure operable piston means for varying the angular setting of the cam ring about the axis of the distributor member to vary the timing of delivery of fuel by the apparatus, a pump for supplying liquid under pressure to a cylinder containing said piston, the pressure of liquid supplied by said pump being arranged to vary in accordance with the speed of operation of the apparatus, a governor mechanism including a centrifugal weight unit mounted in the body, the governor mechanism further including an axially movable output member which is movable by said weight unit in opposition to the force exerted by a governor spring, and linkage connecting said output member to a fuel control member the setting of which determines the amount of fuel delivered by the apparatus at each delivery stroke.

With such apparatus it is desirable in most cases, that the timing of delivery of fuel should, in addition to being dependent upon the speed of the engine, also be dependent upon the load on the engine. It is known to achieve the load variation by modifying the forces acting on said piston means. This can be achieved by modifying the aforesaid pressure applied to the piston, generating another fluid pressure and applying it to the piston or modifying the restoring force of a spring acting on said piston. Each one of these ways requires modification of the fluid circuit of the apparatus and often results in the need for the capacity of the low pressure pump which also supplied fuel to the aforesaid bore, to be increased.

The object of the present invention is to provide an apparatus of the kind specified in a simple and convenient form.

According to the invention, in an apparatus of the kind specified, said piston means comprises a piston, a bore formed in said piston, a servo valve slidable in said bore, said servo valve being subject to the pressure of liquid delivered by the low pressure pump, an axially movable member in said bore a spring engaging said axially movable member to bias the servo valve against the action of the liquid under pressure, a land on said servo valve, a port formed in the wall of said bore, said port communicating with one end of said cylinder, said land co-operating with said port to control the flow of liquid through the port, to determine the position of the piston in the cylinder, and means coupled to the output member of the governor mechanism for altering in accordance with the position of the output member, the distance between the portion of the land which is co-operating with the port and said axially movable member.

An example of a fuel pumping apparatus in accordance with the invention will now be described with reference to the accompanying drawings in which.

With reference to FIGS. 1, 2, 3 and 4 of the drawings, the apparatus comprises a body 10 in which is mounted a rotary cylindrical distributor member 11. This is coupled to a drive shaft 12 which extends to the exterior of the body and which in use is coupled to an associated engine so as to be driven in timed relationship therewith.

Figure 2:
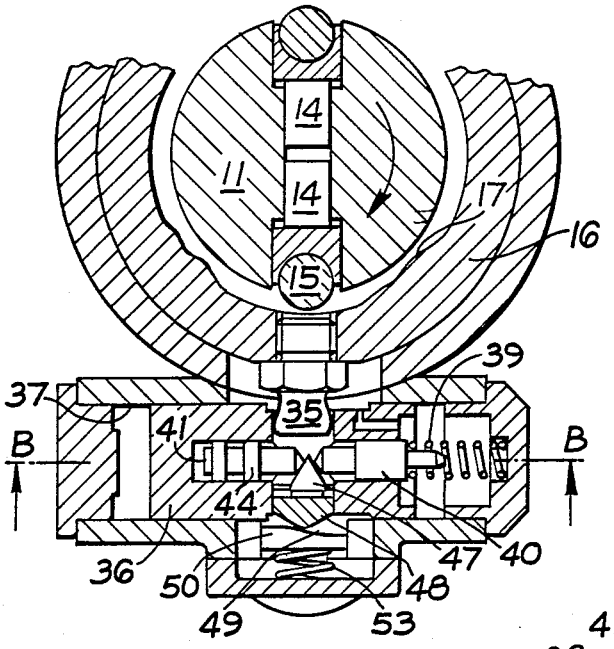
FIG. 2 is a section on the line AA of FIG. 1.

Formed in the distributor member is a transversely extending bore 13 in which is mounted a pair of pumping plungers 14. The plungers 14 at their outer ends, engage shoes which carry rollers 15 for engagement with the internal peripheral surface of an annular cam ring 16 having on its internal perhipheral surface, pairs of cam lobes 17 as shown in FIG. 2.

The bore 13 communicates with a delivery passage 18 positioned to communicate in turn with a plurality of outlets 19, formed in the body and connected in use to the injection nozzles respectively of the associated engine. Registration of the delivery passage with an outlet occurs whilst the plungers can be moved inwardly by the cam lobes.

The bore 13 also communicates with a plurality of inlet passages 20 formed in the distributor member and which can register in turn with an inlet port 21 formed in the body. Such communication takes place whilst the plungers are allowed to move outwardly by the cam lobes and during such communication fuel flows from the outlet 22 of a low pressure supply pump generally indicated at 23, by way of an angularly movable fuel control member in the form of a throttle member 24.

The throttle member has an axial groove which cooperates with a port connected to the inlet port 21. The angular setting of the throttle member determines the degree of registration of the groove with the port and thereby the amount of fuel which flows to the bore 13 whilst an inlet passage is in register with the inlet port. The settng of the throttle member therefore determines the amount of fuel which is delivered by the apparatus at each delivery stroke.

The low pressure pump 23 has a rotary part which is driven from the distributor member 11 and the inlet 25 of the pump is connected to a fuel inlet 26 formed in a valve housing which is secured to the body 10. The valve housing incorporates a spring loaded relief valve generally indicated at 27 and which controls the output pressure of the pump 23 so that the pressure varies in accordance with the speed at which the apparatus is driven.

The setting of the throttle member 24 is determined by a governor mechanism which includes a centrifugal weight mechanism generally indicated at 28, mounted on the shaft 12 and the weight mechanism is coupled to an axially movable output member in the form of a sleeve 29. The sleeve 29 engages one end of a lever 30 the other end of which is coupled to a governor spring 31 which in the example, is a coiled tension spring. The other end of the spring 31 is coupled to a lever 32 which in turn is coupled to a lever 33 at the exterior of the body. The lever 33 is coupled to an operator adjustable control for example the throttle pedal of a vehicle driven by the associated engine. Moreover, the end of the lever 30 which is connected to the spring 31 is coupled by means of a link 34, to an arm extending from the throttle member 24. The arrangement is such that as the speed of rotation of the shaft increases, the weights of the weight unit move outwardly and in so doing move the sleeve 29 in an axial direction against the action of the spring 31. This movement is transmitted by the lever 30 which also imparts angular movement to the throttle member 24 in a direction to reduce the amount of fuel delivered by the apparatus. Conversely if the speed of rotation of the shaft should decrease, then the sleeve will move in the opposite direction and the throttle member will be moved to increase the amount of fuel supplied by the apparatus.

Figure 3:
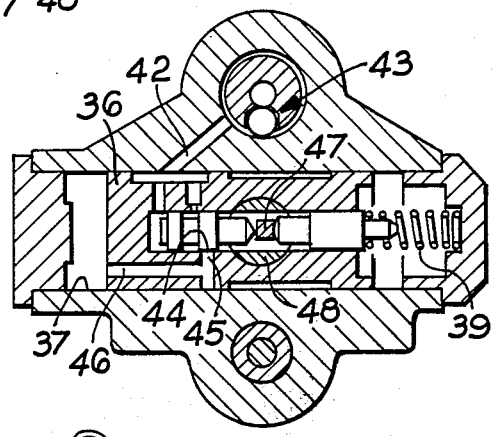
FIG. 3 is a section on the line BB of FIG. 2.
Figure 4:
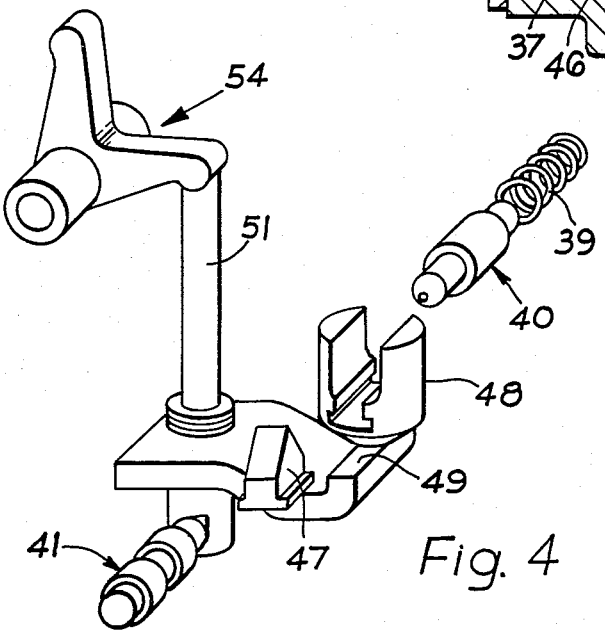
FIG. 4 is a perspective view to an enlarged scale of part of the mechanism seen in the preceding figures.

In order to vary the timing of delivery of fuel, the cam ring 16 is connected by means of a radial peg 35, to a piston 36 which is slidably mounted in a cylinder 37 extending tangentially to the ring. The ends of the cylinder 37 are closed by end closures, one of which forms an abutment for a coiled compression spring 39 which is engaged with an axially movable member 40. A servo valve member 41 is located within a blind bore formed in the piston and the blind end of the bore communicates with a supply passage 42 which is shown in FIG. 3, and this communicates with the outlet 22 of the low pressure pump. An anti-shock valve 43 is provided in the aforesaid passage, this being the usual practice with this type of apparatus. The axially movable member 40 is also slidable in the bore in the piston and the spring acts to bias the valve member against the pressure in the blind end of the bore.

The servo valve member 41 is provided with a land 44, the purpose of which is to control flow of fuel through a port 45 formed in the wall of the bore accommodating the valve member. On one side of the land there is defined a groove which is in constant communication with the passage 42 whilst on the other side of the land 44 there is a space which communicates with the interior of the body of the pump which is maintained at a pressure which is less than the output pressure of the low pressure pump 23. The port 45 communicates with one end of the cylinder 37 which contains the piston conveniently by means of a passage 46 formed in the piston. Assuming for the moment that the of the valve member 41 and axially movable member 40 are in contact with each other, then as the pressure applied to the servo valve member 41 from the passage 42 increases, the servo valve member will move against the action of the spring 39 to expose the port 45 to the groove. Fuel will therefore flow by way of the groove and port to the end of the cylinder containing the piston, and the latter will move in the same direction as the servo valve member to establish a new equilibrium position in which the port 45 is covered by the land 44. If on the other hand the pressure in the passage 42 falls, then the servo valve member will move in the opposite direction under the action of the spring 39 and the port 45 will be exposed to the low pressure thereby permitting fuel to flow from the cylinder and allowing the piston to follow the servo valve member to establish a new equilibrium position.

The servo valve member 41 and the axially movable member are separated by a wedge referenced 47 and shown particularly in FIG. 2. The wedge is slidably accommodated in a slot in a generally cylindrical member 48 which is movable in a bore formed in the piston and extending at right angles to the axis thereof. The cylindrical member 48 is engaged by a surface 49 formed on a projection 50 which is secured to the end of a guide rod 51 slidably mounted in a bushing 52 carried by the body 10. The projection and guide rod are biassed upwardly i.e. in the direction to cause the wedge 47 to separate the axially movable member and the servo valve member, by means of a coiled compression spring 53. Movement of the guide rod and projection in the opposite direction is effected by a bell crank lever 54 one arm of which engages the guide rod 51 and the other arm of which engages a flange 55 formed on the sleeve 29.

Figure 1:
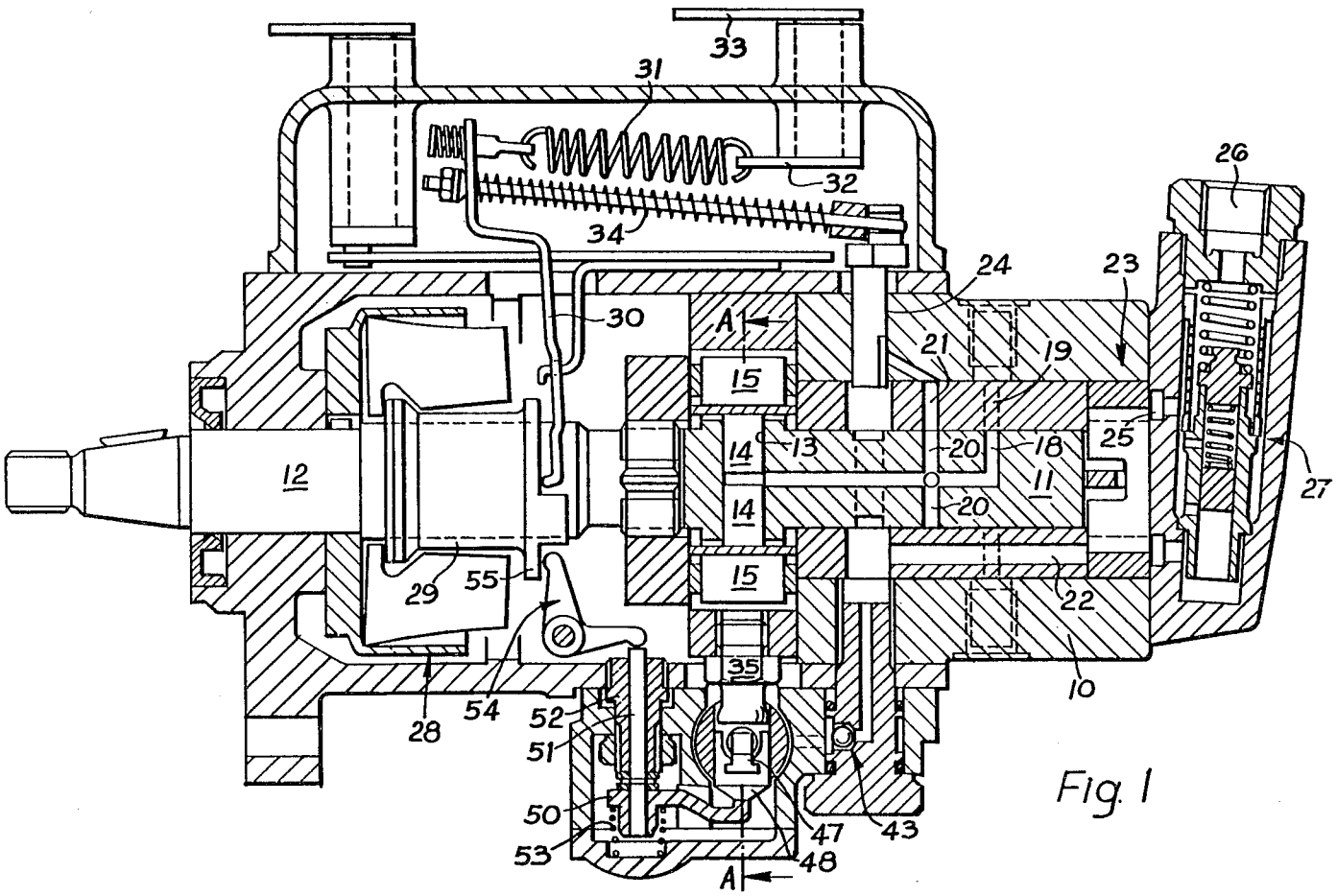
FIG. 1 is a sectional side elevation of the apparatus.

The axial setting of the sleeve 29 since it is coupled to the metering valve member 24 is indicative of the amount of fuel being delivered by the apparatus to the associated engine and it is therefore indicative of the load on the associated engine. As the sleeve moves towards the right as seen in FIG. 1, the amount of fuel supplied to the engine at each delivery stroke will decrease and such movement will cause depression of the projection 50 so that the servo valve member and the axially movable member can move closer together. The practical effect of this is that the distance of the land 44 from the axially movable member engaged by the spring 39 is decreased and the piston 36 will move towards the right thereby causing the cam ring 16 to move in the anti-clockwise direction as seen in FIG. 2. FIG. 2 also indicates the direction of rotation of the distributor member 11 and it will be appreciated that movement of the cam ring 16 in the anti-clockwise direction will cause the timing of delivery of fuel to be advanced. Thus with a reduction in the amount of fuel supplied to the engine the cam ring moves in the direction to advance the timing of delivery of fuel. It will be understood of course that the movement of the sleeve is dependent upon the force exerted by the governor spring and if the lever 33 is moved to increase the force exerted by the spring then the sleeve 29 will move to the left. This will result in an increased flow of fuel to the associated engine and movement of the cam ring 16 in the clockwise direction. Modification of the amount of timing variation caused by movement of the throttle member can be achieved by varying the angle of the faces on the wedge 47 which contact the servo valve member and the axially movable member. A further modification of the timing characteristic can be obtained by shaping the surface 49. In this case however, the aforesaid distance varies in accordance with the axial setting of the piston 36 and this therefore provides a variation in the speed timing characteristic.

Figure 5:
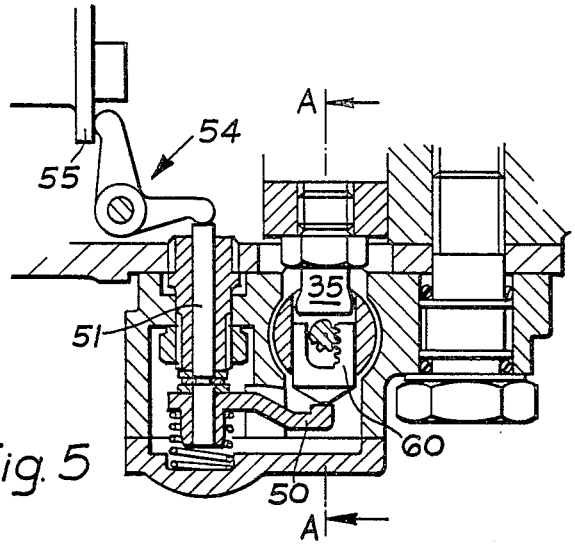
FIGS. 5, 6 and 7 are views similar to FIGS. 1, 2 and 3 showing a modification of the apparatus.
Figure 6:
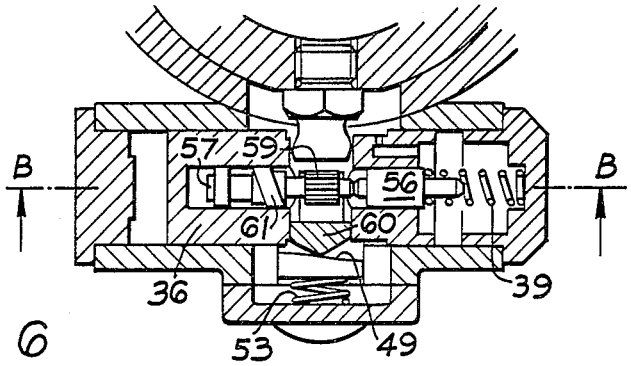
Figure 7:
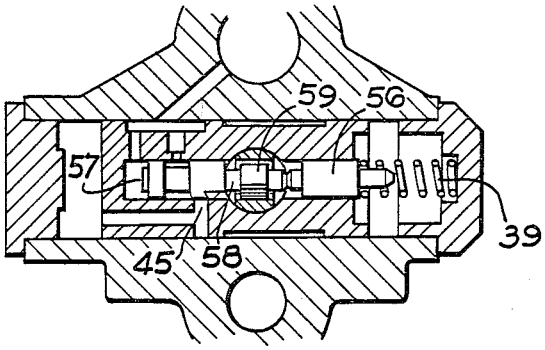

Referring now to FIGS. 5, 6 and 7. The parts in these figures which have the same construction and function as the parts shown in the earlier figures, have been given the same reference numerals. The servo valve 57 is engaged by the axially movable member 56 which itself is engaged by the spring 39 as in the previous example. The valve member 57 has an extension 58 which is provided with a pinion 59 which is engaged by teeth formed on a slotted cylindrical member 60 which corresponds to the cylindrical member 48 shown in the earlier figures. The member 60 as before, engages with the surface 49 on the projection 50 so that as the member 60 is moved in the vertical direction, angular movement will be imparted to the servo valve member 57. As in the previous example, the servo valve member is provided with a land 61 to control the opening of the port 45, but in this case and as clearly seen in FIG. 6, the land is of helical form. As a result the distance between that portion of the land which is covering the port and the axially movable member, varies as the member 60 is moved upwardly and downwardly. For a given speed of operation of the apparatus as the sleeve is moved axially, the servo valve member will move angularly and the piston position will vary as the position of the portion of the land which is controlling the port 45 varies. The inclination of the land and also the degree of angular movement imparted to the valve member as a result of movement of the member 60 are chosen to give the required variation of timing in accordance with variation of the load.

We claim:

1. A liquid fuel injection pumping apparatus comprising a body, a rotary distributor member in the body, a drive shaft coupled to the distributor member and arranged in use to be driven in timed relationship with an associated engine, a bore in the distributor member, a plunger in the bore, an annular cam ring surrounding the distributor member and having cam lobes which impart inward movement to the plunger as the distributor member rotates, fluid pressure operable piston means for varying the angular setting of the cam ring about the axis of the distributor member to vary the timing of delivery of fuel by the apparatus, a pump for supplying liquid under pressure to a cylinder containing said piston means, the pressure of liquid supplied by said pump being arranged to vary in accordance with the speed of operation of the apparatus, a governor mechanism including a centrifugal weight unit mounted in the body, the governor mechanism further including an axially movable output member which is movable by said weight unit in opposition to the force exerted by a governor spring, a linkage connecting said output member to a fuel control member the setting of which determines the amount of fuel delivered by the apparatus at each delivery stroke, said piston means comprising a piston, a bore formed in said piston, a servo valve slidable in said bore, said servo valve being subject to the pressure of liquid delivered by the low pressure pump, an axially movable member in said bore, a spring engaging said axially movable member to bias the servo valve against the action of the liquid under pressure, a land on said servo valve, a port formed in the wall of said bore, said port communicating with one end of said cylinder, said land cooperating with said port to control the flow of liquid through the port, to determine the position of the piston in the cylinder, and means coupled to the output member of the governor mechanism for altering in accordance with the position of the output member, the distance between the portion of the land which is cooperating with the port and said axially movable member.

2. An apparatus according to claim 1 in which said means coupled to the output member comprises a wedge member movable between the servo valve and said axially movable member.

3. An apparatus according to claim 2 in which said wedge is mounted in a cylindrical member slidable in a bore formed in said piston and extending at right angles to the axis of the piston.

4. An apparatus according to claim 3, in which said wedge is slidably mounted in a slot formed in said cylindrical member.

5. An apparatus according to claim 1 in which said land is of helical form and said means coupled to the output member comprises means for adjusting the angular setting of said valve member.

6. An apparatus according to claim 5 in which said valve member is provided with a pinion and said means further comprises a toothed member engaged with said pinion said toothed member being movable in a direction normal to the axis of said servo valve to impart angular movement thereto and being slidable in a bore formed in said piston.

7. An apparatus according to claim 3 or claim 6 in which said means further comprises a projection carried upon a guide rod, lever means coupling said guide rod to said output member, and a surface defined on said projection said surface being engaged by said cylindrical member or said toothed member, said surface extending in the direction of movement of said piston.

8. An apparatus according to claim 7 in which said lever means comprises a bell crank lever.

9. An apparatus according to claim 7 in which said surface is contoured so as to alter said distance as the piston moves within the cylinder.

* * * * *